United States Patent [19]

Anderson

[11] 4,148,365

[45] Apr. 10, 1979

[54] EARTH WORKING ATTACHMENT FOR TRACTORS

[76] Inventor: Ernest L. Anderson, 85115 Florence Rd., Eugene, Oreg. 97405

[21] Appl. No.: 833,018

[22] Filed: Sep. 14, 1977

[51] Int. Cl.[2] ..... E02F 3/76; A01B 59/044

[52] U.S. Cl. ..... 172/781; 172/297; 172/306; 172/742; 172/800

[58] Field of Search ..... 172/297, 303, 307, 308, 172/309, 742, 781, 788, 789, 795, 800, 298, 299, 300, 301, 302, 304, 305, 306

[56] References Cited

U.S. PATENT DOCUMENTS

| | | | |
|---|---|---|---|
| 2,147,207 | 2/1939 | Nikkel | 172/795 |
| 2,390,767 | 12/1945 | Alderman | 172/306 |
| 2,676,527 | 4/1954 | Reustle | 172/307 |
| 2,700,233 | 1/1955 | Johnson et al. | 172/795 |
| 2,883,776 | 4/1959 | Orscheln | 172/788 |
| 3,305,028 | 2/1967 | Schaper | 172/297 |
| 3,381,760 | 5/1968 | Braud | 172/788 |
| 3,618,671 | 11/1971 | Chantland | 172/297 |
| 3,858,663 | 1/1975 | Lurwig, Jr. | 172/742 X |

FOREIGN PATENT DOCUMENTS

| | | | |
|---|---|---|---|
| 1103670 | 3/1961 | Fed. Rep. of Germany | 172/297 |
| 33757 | 9/1964 | Finland | 172/788 |
| 594695 | 6/1959 | Italy | 172/297 |

*Primary Examiner*—Richard T. Stouffer
*Attorney, Agent, or Firm*—James D. Givnan, Jr.

[57] ABSTRACT

An attachment for tractors including a pair of elongate support members attached at their forward ends to the tractor frame and at their rearward ends to the tractor's three point hitch arms. A blade assembly is carried by the elongate members and is adjusted vertically or inclined transversely to the tractor centerline by adjustment of three point hitch components. The blade of the assembly is also rotatable about a vertical pivot with a locking mechanism provided for the blade. A tractor mounted bracket removably mounts the forward ends of the elongate support members.

10 Claims, 6 Drawing Figures

EARTH WORKING ATTACHMENT FOR TRACTORS

BACKGROUND OF THE INVENTION

The present invention relates generally to attachments for tractors and more particularly to a blade attachment wherein the blade is mounted in a removable manner intermediate the front and rear pairs of tractor wheels.

To enhance the usefulness of tractor type vehicles a wide variety of accessories is provided for temporary attachment to same. Included in such attachments is a blade attachment with the blade being positioned forwardly or rearwardly of the tractor chassis by an adjustable support assembly. All blades so mounted incur a common disadvantage during use, the disadvantage being that, during tractor travel over uneven ground, vertical displacement of the blade from a desired course is accentuated by reason of the blade being offset a considerable distance from the axis of such movement. These up and down excursions of the blade during tractor movement result in non-uniform grading of the surface being worked and, if severe, can inhibit tractor travel by excessive blade penetration. A further disadvantage of placement fore or aft of the supporting vehicle is the visibility problem as the blade is largely obstructed by the forward part of the tractor or, conversely if rear mounted, requires that the tractor operator conduct a grading operation looking to the rear to monitor blade operation. Ideally, the blade is disposed intermediate the tractor wheels similar in placement to blade disposition on a motor grader.

While the prior art includes disclosures proposing the mounting of a blade on a tractor amid the chassis ends, the support structure for such mounting is extremely complex by reason of the limited space resulting in a costly tractor attachment and an attachment that is both difficult to mount and remove from the vehicle. Further, the mechanism for tilting and locking of the blade transversely to the tractor centerline is complex rendering the known blade attachments both costly and difficult to mount and remove.

To the extent the prior art is known, blades mounted intermediate the tractor wheels rely largely on manual effort for vertical position by reason of the fact that the central location of the blade is remote from any powered appendages of the tractor. While such manually positioned blades may be acceptable for some very small or garden type tractors, such is not acceptable on medium to large size tractors capable of performing road grading operations.

SUMMARY OF THE PRESENT INVENTION

The present invention is embodied within an attachment for conventional tractors of the type having a three point hitch which is presently utilized to impart positioning movement to an earthworking instrumentality such as a blade.

In the present attachment blade supporting means includes a pair of supporting members for placement lengthwise below the tractor frame and supported at their forward ends in a detachable manner within a tractor mounted bracket. The rearward ends of said members are adjustably supported by the arms of a tractor three point hitch, the latter imparting both vertical as well as differential movement to the members, the latter for blade tilting. A blade assembly is jointly supported by said members and includes a ground engaging blade positionable about multiple axes to provide the highly maneuverable blade capable of performing different grading operations. The supporting members are attached to the forward end of the tractor by means of insertable pins which permit independent positioning of the supporting members about a horizontal axis, additionally, the attachment enables convenient coupling and uncoupling of the supporting members to the tractor. Rearward attachment of the members to the tractor is at the end of the tractor three point hitch arms, which arms typically provide for convenient coupling and uncoupling of various types of tractor attachments which feature is presently utilized. The supporting members may be lengthwise adjustable to render the present attachment useful with various makes and types of tractors.

Important objects of the present invention include the provision of a blade attachment for conventional tractors, which attachment is capable of both ready installation and removal from the tractor; the provision of a blade capable of performing desired grading operations requiring movement of the blade about multiple axes; the provision of a blade attachment utilizing elongate support members attached to the tractor at their forward ends in a manner permitting independent vertical adjustment of a supporting member to transversely incline the attachment blade; the provision of a blade attachment including blade supporting members in coupled engagement at their rearward ends with the three point hitch of a tractor permitting the latter to impart both vertical movement to the blade through out a wide range of travel as well as transversely inclining movement thereto; the provision of a blade attachment for a tractor wherein removal of the attachment may be accomplished in a convenient manner within a few minutes to return the tractor to its original configuration; the provision of a blade attachment of low-cost, durable construction not requiring tractor modification; the provision of a tractor blade attachment wherein the blade is located ideally intermediate the front and rear wheels of the tractor whereby downwardly exerted blade loads are ultimately imparted to the tractor rear wheels to increase wheel traction.

DETAILED DESCRIPTION OF THE PREFERRED EMBODIMENT

Figures 1, 2, 3, 4, 5, 6:
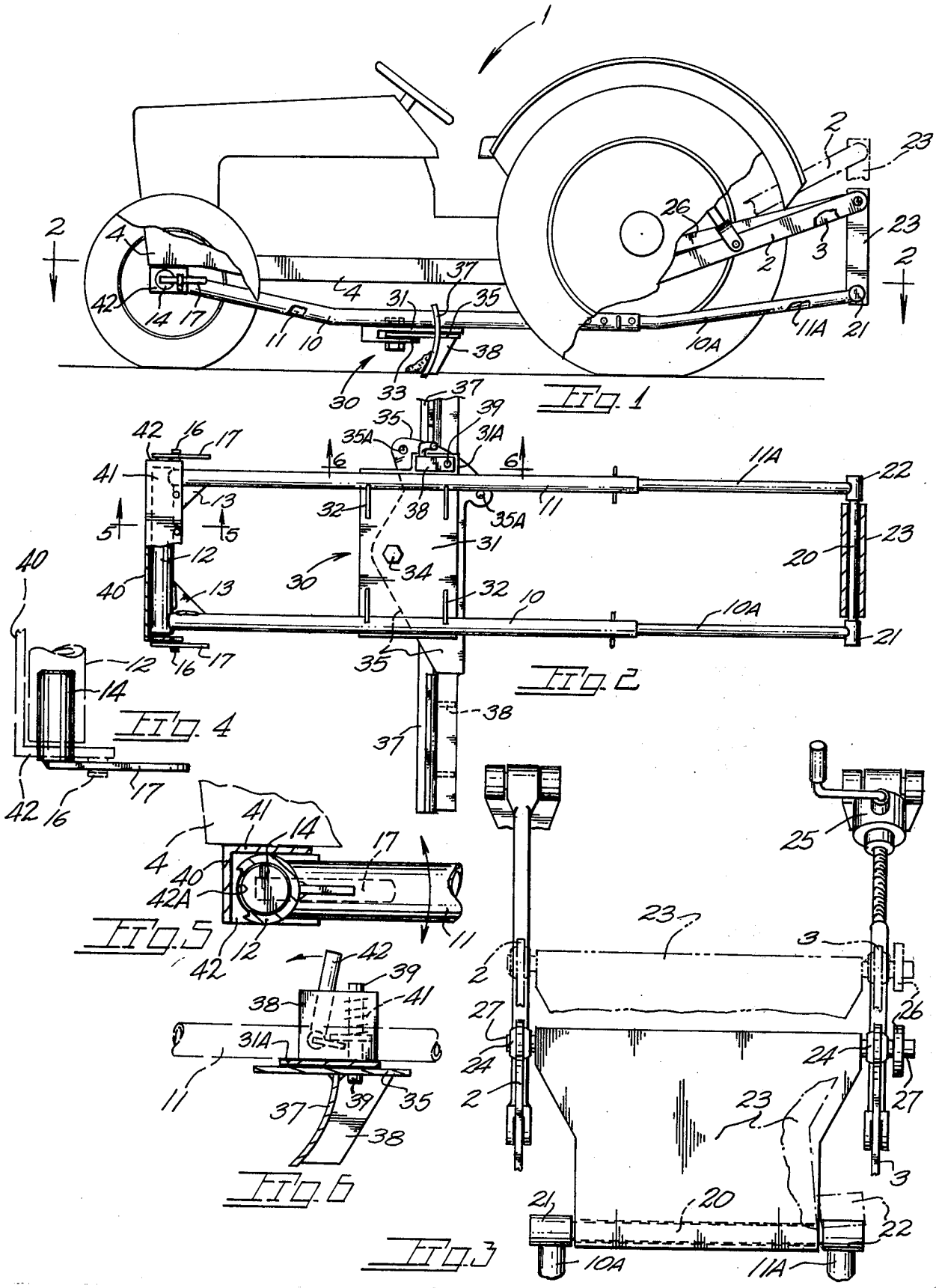
FIG. 1 is a side elevational view of a conventional tractor equipped with the present blade attachment with tractor parts broken away for purposes of illustration.
FIG. 2 is a plan view of the present attachment taken along line 2—2 of FIG. 1 with the attachment shown removed from the tractor.
FIG. 3 is a rear elevational view of the present attachment with adjusted positions of the attachment shown in single and double dot broken lines.
FIG. 4 is a fragmentary plan view of a pin mounting arrangement for the forward end of the supporting members.
FIG. 5 is a vertical sectional view taken along line 5—5 of FIG. 2 showing additional details of the mounting arrangement for the forward end of the blade supporting members.
FIG. 6 is a vertical sectional view taken along line 6—6 of FIG. 2 showing details of a blade locking mechanism retaining the blade in place about an upright axis.

With continuing reference to the accompanying drawing, the reference numeral 1 indicates generally a conventional tractor which may be of the agricultural type or that type referred to as a lawn or garden tractor which has recently found wide acceptance among homeowners having sizable grounds and gardens to maintain. Tractors are usually equipped with what is popularly termed a three point hitch located at their rearward end for the adjustable attachment of various accessories. The three point hitch includes arms at 2 and 3 both pivotally supported at their forward ends to permit the support of an accessory in a vertically adjustable manner and which arms often include the provision for varying the effective length of a point hitch arm member for the purpose of inclining the attached accessory transversely of the tractor centerline. Typically, the rearwardly extending arms of such a hitch are positioned by means of a power takeoff arrangement from the tractor driveline. While the present invention is described and shown in association with the three point hitch of a conventional tractor, it is to be understood that various tractor mounted appendages may be used to impart lifting motion to the present blade attachment.

With attention now to the present invention, blade supporting means includes a pair of blade supporting members indicated at 10 and 11, each extending lengthwise of the tractor below the tractor frame or chassis indicated at 4. The supporting members are of tubular construction having a forward crossmember 12, also of tubular construction, suitably gusseted at 13. While the forward ends of the supporting members are shown interconnected, the same are capable of independent vertical movement by reason of their length. Crossmember 12 is of open construction to receive end inserted pins as at 14, the latter being insertable through end walls of a tractor mounted bracket. Each end wall is apertured, as later described, to receive a pin 14, the latter held in inserted placement within crossmember 12 by means of a clip 16 retaining a pin handle 17 against outward displacement. The mounting of the forward ends of elongate support members 10 and 11, as above described, permits independent vertical movement of each member in response to three point hitch actuation as crossmember 12 may flex torsionally to facilitate support member movement. Said support members may be telescopic and include adjustable segments 10A and 11A to permit use of the present attachment with various size tractors. Interconnecting the rearward ends of the support members is a shaft 20 which terminates endwise in fittings 21 and 22 carried by the ends of the support members.

Coupling means at 23 serves to interconnect the rearward ends of support members 10–11 with the ends of three points hitch arm 2 and 3. A pair of spherical bearings at 24 carried by the hitch arm ends receive stub shafts 27 on coupling means 23. Adjustment means at 25, conventional on most three point hitch arrangements, is utilized to impart adjusted vertical movement to one of said hitch arms as shown in FIG. 3 (in the single dot broken line position) to incline coupling means 23 and hence raise one support member end relative to the remaining support member. The individual adjustment of a hitch arm and its corresponding support member will ultimately raise or lower the support member associated therewith and also transversely incline a later described blade. To prevent undesired lateral motion of the rearward ends of support members 10 and 11, a sway bar at 26 may be attached to an arm end and to a pivot point on the tractor chassis. The provision of a sway bar in attachment with a hitch arm is well known.

An earthworking assembly is indicated generally at 30 and is suspended below supporting members 10 and 11 at a point intermediate the front and rear wheels of the tractor. The assembly includes a base having a plate 31 secured to the underside of each support member 10–11 and reinforced by suitable bracing as at 32. The base also includes a lower plate member at 33 which is spaced below the base to receive therebetween a horizontally disposed plate 35 associated with a positionable ground working blade 37. A pivot pin assembly at 34 extends through base 31 and lower plate 33 to pivotally secure triangular plate 35 therebetween.

Blade construction includes blade 37 reinforced at points therealong by upwardly extending weldments 38 spaced along the backside of the blade. To provide adequate blade clearance below supporting members 10 and 11, a central portion of the blade is recessed and thereat supports plate 35 which as aforesaid is in securement with blade attached weldments 38. End segments of the blades are of a height shown in FIG. 1.

A locking mechanism is carried by base 31 of the blade assembly as best shown in FIG. 6. An extension 31A of the base, outboard of support member 11, serves to receive the lock mechanism which includes a housing 38 within which a locking pin 39 is slidably mounted. Said pin is biased by a spring member 41 for sliding engagement with plate 35 and specifically plate apertures 35A therein. A pin release arm at 42 journalled in housing 38 enables the operator to extract pin 39 from an aperture 35A to permit subsequent positioning of the blade about the upright axis of pivot assembly 34.

Raising and lowering of blade assembly 30 is, as earlier mentioned, by means of the three point hitch arms while differential movement of said arms is by adjustment means 25 and permits transverse inclining of the blade to the tractor centerline. A blade, so positioned, may thereafter be raised or lowered by the power arms of the tractor.

The front mounted bracket of the tractor is of angle iron construction having a front wall 40 and a top wall 41 while end walls 42 close the bracket ends. Each end wall 42 defines an opening 42A of a size to receive pin 14 which extends therepast and fits snugly within the open end of interconnecting member 12.

Installation of the present attachment is accomplished by backing of the tractor in place over the attachment with subsequent positioning of supporting members 10 and 11 and interconnecting crossmember 12 so as to enable insertion of pins 14 through end plates 42 of the bracket into internal engagement with the ends of crossmember 12. Subsequent to insertion of pins 14 and the locking engagement of pin associated handle 17 with clips 16, the rearward ends of supporting members 10 and 11 and coupling means 23 are attached to the outer ends of the three point hitch arms 2 and 3.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. An earthworking attachment for disposition below a tractor frame, the tractor being of the type having vertically adjustable arms at its rearward end, said tractor further being of the type having a pair of wheels adjacent its forward end and another pair of wheels adjacent its rearward end, said attachment comprising, an assembly including an earthworking instrumentality for ground contact and adapted to be located between the tractor front and rear pairs of wheels, elongate assembly support means adapted for lengthwise disposition below and along the length of the tractor frame, said support means comprising elongate tubular members adapted for independent vertical positioning by the adjustable tractor arms, bracket means securable to the tractor frame at the forward end thereof for coupling the forward end of said suport means to the tractor frame in a manner permitting vertical adjustment of said support means means for coupling the rearward end of said support means to the adjustable arms of the tractor whereby up and down positioning of the assembly may be accomplished by said adjustable arms, said coupling means interconnecting the rearward ends of said tubular members in a manner permitting the height of one of said tubular members to be varied by an adjustable tractor arm relative to the height of the remaining tubular member to impart inclination to the instrumentality transversely of the tractor centerline.

2. The attachment claimed in claim 1 wherein a crossmember interconnects the forward ends of the tubular members.

3. The attachment claimed in claim 2 wherein said bracket means includes detachable pin means insertably engageable with said crossmember.

4. The attachment claimed in claim 3 wherein said pin means comprises a pair of pins oppositely insertable through the opposite ends of said bracket and into the opposite ends of said crossmember.

5. The attachment claimed in claim 4 wherein said bracket means includes clips at each of its ends, each pin of said pair of pins having a handle engageable with one of said clips to prevent axial displacement of its associated pin.

6. The attachment claimed in claim 1 wherein said tubular members each include telescopic segments to enable use of the present attachment with tractors of different lengths.

7. The attachment claimed in claim 1 wherein said bracket means is disposed substantially intermediate the tractor front wheels.

8. The attachment claimed in claim 1 wherein said bracket means is of wall construction, a pin insertably engageable with a wall of said bracket means to retain the forward end of said elongate assembly support means in place within said bracket means.

9. In combination, a tractor having a lengthwise extending frame, said tractor including vertically adjustable arms at its rearward end, said tractor further including a pair of wheels adjacent its forward end and another pair of wheels adjacent its rearward end, and an earthworking attachment disposed below the tractor frame and including an earthworking assembly having an instrumentality for ground contact located between the tractor front and rear pairs of wheels, elongate assembly support means disposed below the tractor frame, bracket means secured to the tractor frame at the forward end thereof and coupling the forward end of said support means to the tractor frame in a manner permitting vertical adjustment of said support means, means coupling the rearward end of said support means to the adjustable arms of the tractor for upward and downward positioning of said instrumentality, said bracket means transferring operational loads to the forward end of the tractor frame, said bracket means being remotely forwardly spaced from the earthworking instrumentality to provide a remote axis about which the earthworking instrumentality adustably moves.

10. The combination claimed in claim 9 wherein said elongate assembly support means extends the full length of the tractor frame.

* * * * *